US005520616A

United States Patent [19]

Hofmeister

[11] Patent Number: 5,520,616

[45] Date of Patent: May 28, 1996

[54] BABY BURPER APPARATUS AND METHOD

[76] Inventor: Tom L. Hofmeister, 1204 St. Andrews Blvd., Eustis, Fla. 32726

[21] Appl. No.: 349,727

[22] Filed: Dec. 5, 1994

[51] Int. Cl.[6] ..... A61H 1/00

[52] U.S. Cl. ..... 601/74; 601/46; 601/70; 601/80; 128/898

[58] Field of Search ..... 601/67, 69, 70, 601/72–74, 78–81, 46, 47, 49, 56, 57, 71; 128/898

[56] References Cited

U.S. PATENT DOCUMENTS

| | | | |
|---|---|---|---|
| 1,896,351 | 2/1933 | Doran | 601/74 |
| 3,234,933 | 2/1966 | Martin | 601/41 |
| 3,461,859 | 8/1969 | Fortnam | 601/74 |
| 3,580,245 | 5/1971 | Dill | 601/70 X |
| 3,779,238 | 12/1973 | Cutler et al. | 601/73 |
| 4,025,809 | 5/1977 | Teranishi | 601/72 X |
| 4,633,856 | 1/1987 | Havstad | 601/107 |
| 4,681,096 | 7/1987 | Cuervo | 601/59 |
| 4,947,832 | 8/1990 | Blitzer | 601/56 |
| 5,063,912 | 11/1991 | Hughes | 600/28 X |
| 5,167,226 | 12/1992 | Larocke et al. | 601/70 |

*Primary Examiner*—Robert A. Hafer
*Assistant Examiner*—Brian E. Hanlon
*Attorney, Agent, or Firm*—William M. Hobby, III

[57] ABSTRACT

A baby burper apparatus aids in the release of stomach gas in a baby and includes a housing having one side having a generally arcuate surface shaped to fit onto a portion of a baby's body, which portion is padded. The housing can have a cloth covering and a hand support strap for holding a person's hand. A vibrating mechanism is mounted in the housing to vibrate the arcuate side of the housing and an electric switch allows the apparatus to be turned on and off with the same hand supporting the apparatus. The method includes selecting a baby burping apparatus as above and placing the arcuate side thereof onto a baby's body adjacent the baby's stomach area and then actuating the apparatus to vibrate or jiggle the area adjacent the baby's stomach to force eructation or release of gas from the baby's stomach. A cloth cover can be moved and cleaned or replaced.

3 Claims, 1 Drawing Sheet

BABY BURPER APPARATUS AND METHOD

BACKGROUND OF THE INVENTION

The present invention relates to a baby burper apparatus and method for aiding in the release of stomach gas in a baby.

Adults responsible for the care of small infants are usually trained to provide for the relief of stomach gas from a baby's stomach in a safe constructive manner. It is common for the parent or caregiver to place an infant on their shoulder, patting the baby until gas is released from the stomach. Gas forming in the stomach must be relieved from the baby's stomach to avoid a condition known as "colic", which is gas pressure formed in the intestine which can become painful to the infant. This process of relieving gas can become time consuming and place a burden upon the infant as well as a parent or caregiver. Relieving the gas from the baby can be harmful or fatal causing injury to the neck, spinal column or shoulder blade area of the infant when the infant is patted too hard by a parent or babysitter. In addition, anyone not properly trained can especially cause harm to the infant.

One object of the present invention is to provide a parent with a safe and effective method and apparatus for relieving stomach gases from a small infant which is accomplished by using a custom contoured and hand-held vibrating or jiggling unit which can be operated with one hand positioned on the infant while the parent is in a sitting position with the baby placed face down across the parent's leg or in an upright position placed against the parent's shoulder. The present invention is directed to be supported and operated with one hand, leaving the other hand and arm free to support the infant during the release of stomach gases.

SUMMARY OF THE INVENTION

A baby burper apparatus aids in the release of stomach gas in a baby and includes a housing having one side having a generally arcuate surface shaped to fit onto a portion of a baby's body, which portion is padded. The housing can have a cloth covering and a hand support strap for holding a person's hand. A vibrating mechanism is mounted in the housing to vibrate the arcuate side of the housing and an electric switch allows the apparatus to be turned on and off with the same hand supporting the apparatus. The method includes selecting a baby burping apparatus as above and placing the arcuate side thereof onto a baby's body adjacent the baby's stomach area and then actuating the apparatus to vibrate or jiggle the area adjacent the baby's stomach to force eructation or release of gas from the baby's stomach. A cloth cover can be moved and cleaned or replaced.

BRIEF DESCRIPTION OF THE DRAWINGS

Other objects, features, and advantages of the present invention will be apparent from the written description and the drawings in which.

DESCRIPTIVE OF THE PREFERRED EMBODIMENT

Figure 1:
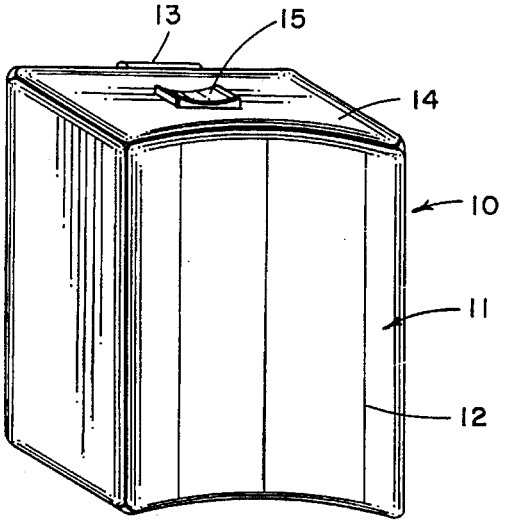
FIG. 1 is a perspective view of a baby burper apparatus in accordance with the present invention.

Referring to the drawing FIGS. 1–6, a baby burper apparatus 10 is illustrated having a housing 11 having an arcuate surface 12 formed on one side thereof and an elastic hand strap 13 running transverse to the arcuate surface 12 on the opposite side 14 of the housing 11. A rocker switch 15 is formed on the housing side 16 adjacent the thumb 17 of a person's hand 18 placed in the strap 13. The thumb can easily reach and activate the baby burping mechanism by pushing a switch 15 of FIG. 4. The housing 11 has a cloth cover 20 having a zipper 21 on one end thereof which can be unzipped to remove the cover for cleaning or replacing.

Figure 5:
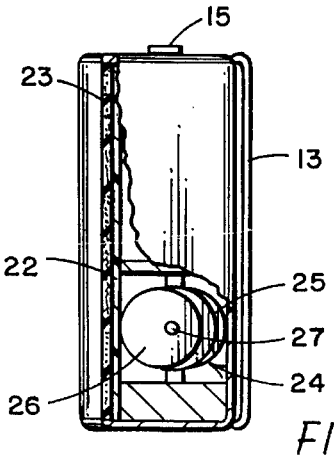
FIG. 5 is a cut-away elevation showing the vibration mechanism of a baby burper apparatus of FIGS. 1–4.

The housing, as seen from the inside in FIG. 5, has a rigid or semi-rigid arcuate surface 22 following the arcuate exterior surface 12 which has a padding 23 placed thereover. Behind the rigid surface 22 is mounted a vibrating mechanism 24 including an electric motor 25 and a pair of eccentric wheels 26, which can be made of a hard rubber or other material as desired, and which rotate in an eccentric manner with their axis 27 placed off center so that the eccentric rubbing against the rigid surface 23 will cause a vibration having a frequency variable with the speed of the motor and having an amplitude dependent upon the eccentric 26 and how much the axis 27 is placed off center. A larger amplitude can produce a jiggling more than a vibration movement as desired to force the release of gas from a baby's stomach. It should be noted that the arcuate surface 12 is specifically shaped to fit onto a portion of a baby's body, as shown in FIG. 2, to produce a vibration or jiggling within an area adjacent the stomach to encourage the release of gas from the stomach area.

Figure 6:
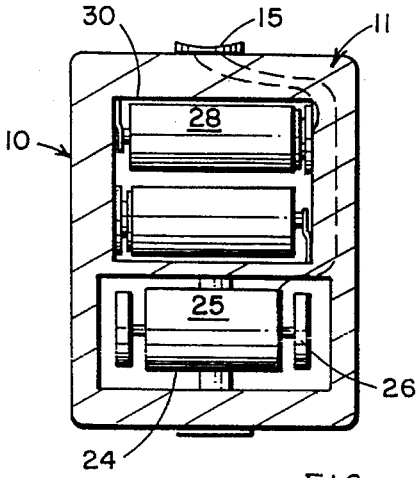
FIG. 6 is a sectional view taken through the baby burper apparatus.

As shown in FIG. 6, the vibratory mechanism is operated by a pair of batteries 28 held in a battery compartment 30 and operated by the switch 15. It should, of course, be clear that the apparatus can be connected to an electrical receptacle through a transformer to produce a low voltage for operating the electric motor 25. A pair of eccentric wheels 26 are used in the vibratory mechanism 24. It should, of course, be clear that other types of vibratory mechanisms can be used in the present invention without departing from the spirit and scope of the invention. For instance, it is also common to use rapidly reciprocating linear motors especially where higher frequency vibration is desired.

Figure 2:
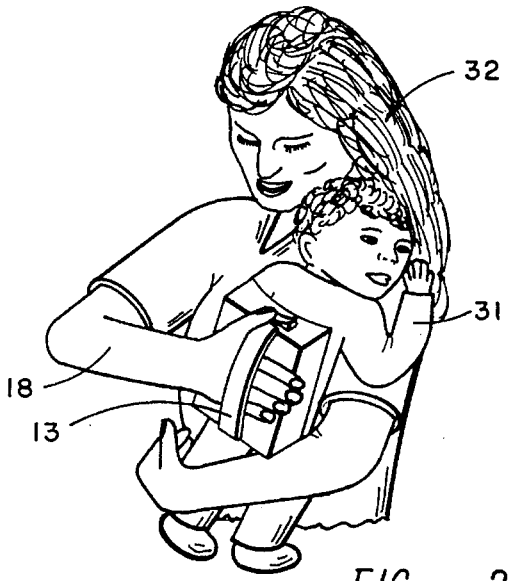
FIG. 2 is a perspective view of the apparatus of FIG. 1 placed on a baby.

As seen further in FIG. 2, a mother 32 has a baby 31 with the baby burping apparatus 10 placed on a portion of its body 32 for burping the baby. It should, however, be clear that the baby can be laid in the lap of an individual or placed over the shoulder and the baby burping apparatus 11 placed thereon for burping the baby without patting or hitting the baby on the back as is commonly done.

Figure 3:
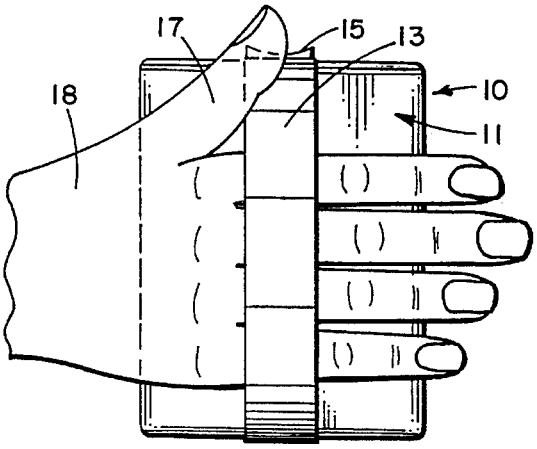
FIG. 3 is a rear elevation of the baby burper apparatus of FIGS. 1 and 2 supported by a person's hand.
Figure 4:
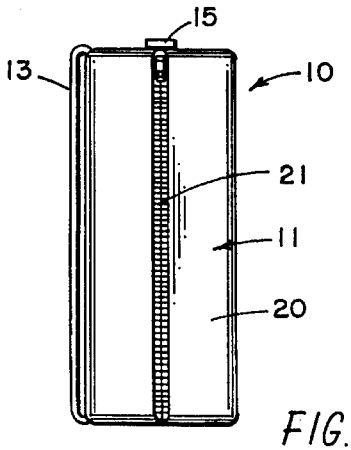
FIG. 4 is a side elevation of the apparatus of FIGS. 1–3.

A method of burping the baby to release gas from the baby's stomach includes selecting a mechanism, as described in connection with FIGS. 1–6, placing the apparatus 10 on a person's hand 18, as shown in FIG. 3, placing the apparatus on the baby's body in a predetermined position, and actuating a switch 13 with the thumb 17 and holding the apparatus during the operation of the vibratory mechanism 24 until the baby has been relieved of any stomach gases. The process may also include using the elastic strap 13 to hold a person's hand 18 and in placement of the cloth cover 20 over the apparatus and closing the cover with the zipper 21.

It should be clear at this time that an apparatus for aiding in the release of stomach gas from a baby's stomach has been provided which is safe and easy to use. However, it should also be clear that the present invention is not to be consideration limited to the forms shown which are to be considered illustrated rather than restrictive.

I claim:

1. A method of burping a baby to relieve gas from the baby's stomach comprising the steps of:

selecting a baby burping apparatus for relief of stomach gas in a baby having a housing having a plurality of sides thereto and having one side thereof having a generally arcuate surface shaped to fit against a baby's body adjacent the baby's stomach, and said housing having a hand support strap attached thereto and said selected baby burping apparatus having an electrically driven vibrating mechanism mounted in said housing and attached to vibrate said one arcuate surface of said housing;

attaching a cloth cover over said selected baby burping apparatus;

placing said selected baby burping apparatus one arcuate side over a baby's stomach area;

actuating said selected baby burper apparatus to jiggle the stomach area of the baby to aid in the release of gas from said baby's stomach.

2. A method of burping a baby to relieve gas from the baby's stomach in accordance with claim 1 including the step of grasping said baby burping apparatus with one hand and attaching said strap thereto and then actuating said baby burper apparatus.

3. A method of burping a baby to relieve gas from the baby's stomach in accordance with claim 2 including the step of supporting a baby against said baby burping apparatus while actuating said apparatus.

* * * * *